United States Patent [19]

White et al.

[11] Patent Number: 4,598,963

[45] Date of Patent: Jul. 8, 1986

[54] CIRCUIT BOARD COMPOSITE CONNECTOR

[75] Inventors: Cyril J. White, Chandlers Ford; Christopher Joyce, Southampton, both of England

[73] Assignee: BICC Public Limited Company, London, England

[21] Appl. No.: 548,739

[22] Filed: Nov. 4, 1983

[30] Foreign Application Priority Data

Nov. 5, 1982 [GB] United Kingdom ..... 8231713
Dec. 7, 1982 [GB] United Kingdom ..... 8234858

[51] Int. Cl.[4] ..... H01R 11/20; H01R 11/22

[52] U.S. Cl. ..... 339/17 C; 339/97 R; 339/258 R

[58] Field of Search ..... 339/17 C, 97 R, 97 P, 339/98, 99 R, 217 R, 221 R, 221 M, 258 R, 258 P, 65, 66 R, 66 M

[56] References Cited

U.S. PATENT DOCUMENTS

| | | | |
|---|---|---|---|
| 3,621,445 | 11/1971 | Horecky et al. | 339/17 C |
| 3,713,080 | 1/1973 | Kennedy | 339/258 R |
| 3,777,303 | 12/1973 | McDonough | 339/17 C X |
| 3,853,389 | 12/1974 | Occhipinti | 339/258 R X |
| 4,050,772 | 1/1976 | Birnholz et al. | 339/220 |
| 4,087,150 | 5/1978 | Kubik | 339/97 P |
| 4,141,618 | 2/1979 | Reavis, Jr. et al. | 857/68 |
| 4,171,858 | 10/1979 | Knowles et al. | 339/99 |

FOREIGN PATENT DOCUMENTS

| | | | |
|---|---|---|---|
| 1152170 | 8/1963 | Fed. Rep. of Germany | 339/217 R |
| 2004425 | 3/1979 | United Kingdom . | |
| 2022334 | 12/1979 | United Kingdom . | |
| 2022939 | 12/1979 | United Kingdom . | |
| 2083958 | 3/1982 | United Kingdom | 339/97 R |

OTHER PUBLICATIONS

Bulletin Entitled "Blue Streak Cable/Connector System, 1974, Ansley Electronics Corp., Los Angeles, CA.

*Primary Examiner*—Gil Weidenfeld
*Assistant Examiner*—Steven C. Bishop
*Attorney, Agent, or Firm*—Buell, Ziesenheim, Beck & Alstadt

[57] ABSTRACT

A composite connector for use with a circuit board is formed from a folded sheet metal preform and has, at one end, a socket in which a terminal pin of a circuit component can be resiliently gripped and, at the other end, a tubular end portion including two bifurcated contacts for displacing the insulating covering of an insulated wire when it is introduced between their limbs. The longitudinally extending free edges of the folded preform in the socket are circumferentially spaced with respect to the longitudinally extending free edges of the folded preform in the tubular end portion. Integral resilient tongues in the socket for effecting electrical contact with a terminal pin of a circuit component are circumferentially spaced with respect to the slots bounded by the limbs of the bifurcated contacts.

12 Claims, 8 Drawing Figures

CIRCUIT BOARD COMPOSITE CONNECTOR

This invention relates to composite connectors for use with circuit boards.

One kind of circuit board that is in general use comprises a board of electrically insulating material, which board has bonded on one of its surfaces a regular pattern of strips of electrically conductive metal or metal alloy, usually but not necessarily copper, and has, extending through the board and the overlying electrically conductive metal strips, a multiplicity of holes distributed at spaced positions along the strips. Circuit boards of this kind will hereinafter, for convenience, be referred to as "a circuit board of the kind described".

It is an object of the present invention to provide, for use with a circuit board of the kind described, an improved composite connector which is simple in form and inexpensive to manufacture.

According to the invention, we provide an improved composite connector formed from a preform of electrically conductive sheet metal or metal alloy which is foled to form a tube having a seam defined by longitudinally extending free edges of the preform and extending from end to end of the composite connector and which is shaped to form, at one end of the composite connector, a socket of substantially circular cross-section which will make a fit in a hole in the circuit board and in which a terminal pin of a circuit component can be resiliently gripped and, at the other end of the composite connector, a tubular end portion of substantially circular cross-section having longitudinally extending slots which are at substantially diametrically opposed positions and whose axes lie in a plane transverse to the plane common to the axes of the composite connector and of said seam, each of which slots open into that end of the composite connector and is bounded by marginal portions of said tubular end portion, which marginal portions and the slot bounded thereby constitute the limbs and an insulated wire-receiving opening of a bifurcated contact, the arrangement being such that, when a length of insulated wire is introduced into the opening between the limbs of each bifurcated contact, the limbs will displace the insulated covering of the wire to effect an electrical connection with the wire at at least two positions spaced along its length, wherein parts of said longitudinally extending free edges defining the seam in the socket are circumferentially spaced with respect to parts of said longitudinally extending free edges defining the seam in the tubular end portion, wherein the thickness of the preform is such that the wall thickness of the socket and the wall thickness of the tubular end portion are substantially equal, and wherein the socket has, integral with that part of the preform forming the socket, resilient contact means for effecting electrical contact with a terminal pin of a circuit component, said integral resilient contact means being circumferentially spaced with respect to said slots.

The longitudinally extending free edges of the folded preform in the socket and in the tubular end portion may abut or they may be spaced a short distance apart.

Preferably, the integral resilient contact means of the socket comprises a single resilient tongue which is folded radially inwardly from a window in the wall of the socket to such an extent that a terminal pin of a circuit component can be resiliently gripped between the tongue and a part of the wall of the socket substantially diametrically opposite the tongue, or it comprises a pair of diametrically opposed resilient tongues which are folded radially inwardly from windows in the wall of the socket and between which a terminal pin of a circuit component can be resiliently gripped.

Where the socket has a single integral resilient tongue the socket may have, substantially diametrically opposite the integral resilient tongue, a radially inwardly extending protrusion so that a terminal pin of a circuit component will be resiliently gripped between the integral resilient tongue and the diametrically opposed inwardly extending protrusion.

Preferably, the or each integral resilient tongue of the socket has a substantially flat contact surface. To facilitate introduction of a terminal pin of substantially rectangular transverse cross-section when the composite connector is fitted in a hole in a circuit board of the kind described with the common axis of its bifurcated contacts orientated to facilitate introduction into the slot of an insulated conductor without fouling an adjacent composite connector, preferably the flat surface of the or each integral resilient tongue lies in a plane at an acute angle to the common axis of the bifurcated contacts, which acute angle preferably lies in the range 60° to 65° to the common axis of the bifurcated contacts. In a preferred embodiment, this angle is approximately 60°.

The contact surface of the or each integral resilient tongue may carry a coating of gold or other metal or metal alloy of high electrical conductivity.

The socket may also have diametrically opposed radially inwardly extending protrusions whose common radially extending axis preferably lies substantially parallel to the plane containing the flat contact surface of the or each integral resilient tongue, these protrusions serving as guides for a terminal pin of a circuit component.

The preform from which the improved composite connector is formed preferably is of a copper-rich alloy, e.g. a copper-beryllium alloy, and it may have an overall protective coating of a tin-nickel alloy.

Preferably, the opposed faces of the limbs of each bifurcated contact of the composite connector over at least a part of their lengths nearer the closed end of the slot bounded by the limbs and over at least a part of their widths are substantially flat and these faces may lie substantially parallel to the plane common to the axes of the bifurcated contacts and of the composite connector or they may lie in planes which converge in a direction towards the axis of the composite connector. Alternatively, these opposed faces of the limbs of each bifurcated contact may be of such a form that, over a radially outer part of their widths, they are substantially flat and lie in planes which converge in a direction towards the axis of the composite connector and, over a radially inner part of their widths, they are substantially flat and lie substantially parallel to the plane common to the axes of the bifurcated contacts and of the composite connector.

The radially inner and outer surfaces of the limbs of the bifurcated contacts may be substantially flat and, in this case, preferably they lie in planes substantially normal to the common plane containing the axes of the bifurcated contacts and of the composite connector.

The improved composite connector of the present invention may include any one or more of the optional features of the composite connector described and claimed in the specification of co-pending British Patent Application No. 8127769 of Vero Electronics Ltd.

Improved composite connectors of the present invention may constitute integral parts of an improved bandoleer of composite connectors forming the subject of our co-pending patent application Ser. No. 06/548,738, filed on the same day as the present application.

The invention is further illustrated by a description, by way of example, of a preferred composite connector for use with a circuit board of the kind described, with reference to the accompanying drawings, in which.

Figure 1:
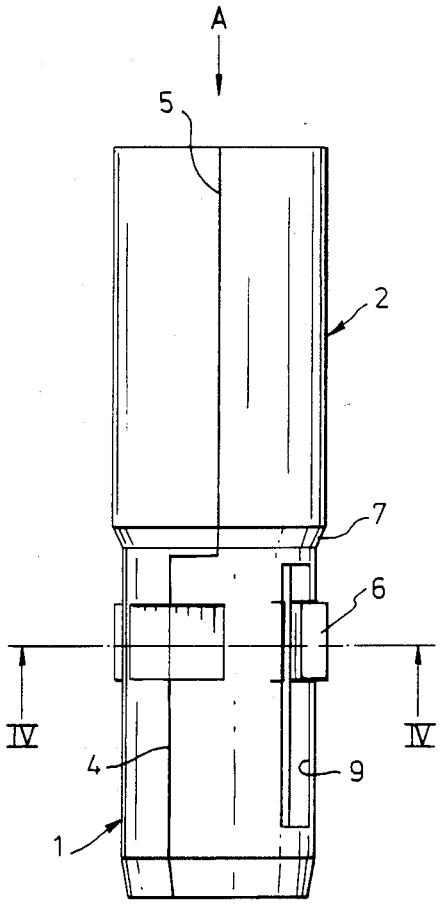
FIG. 1 is a side elevation of the preferred composite connector drawn on a greatly enlarged scale.
Figure 3:
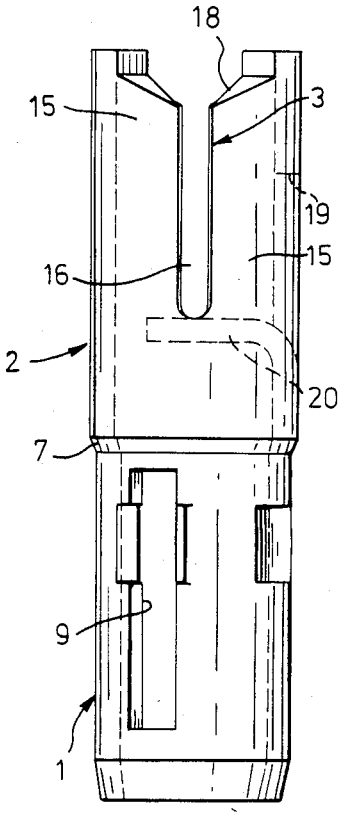
FIG. 3 is a side elevation of the composite connector looking in the direction of arrow B in FIG. 2.
Figure 2:
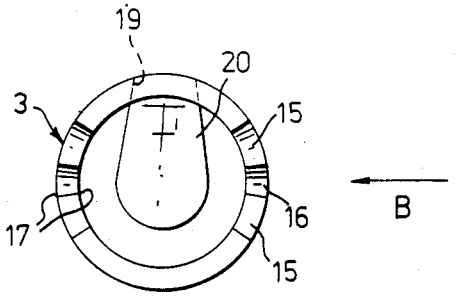
FIG. 2 is an end view of the composite connector shown in FIG. 1 looking in the direction of arrow A.
Figure 4:
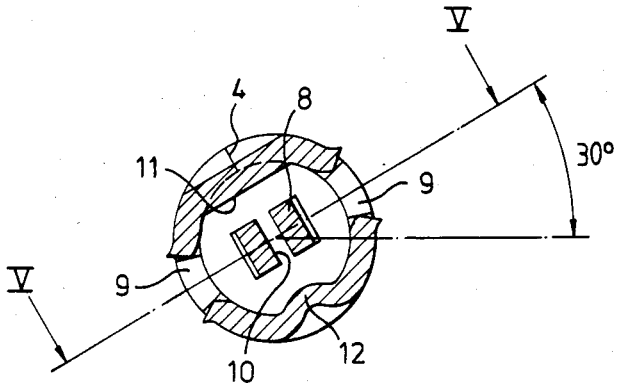
FIG. 4 is a transverse cross-sectional view of the composite connector taken on the line IV—IV in FIG. 1.
Figure 5:
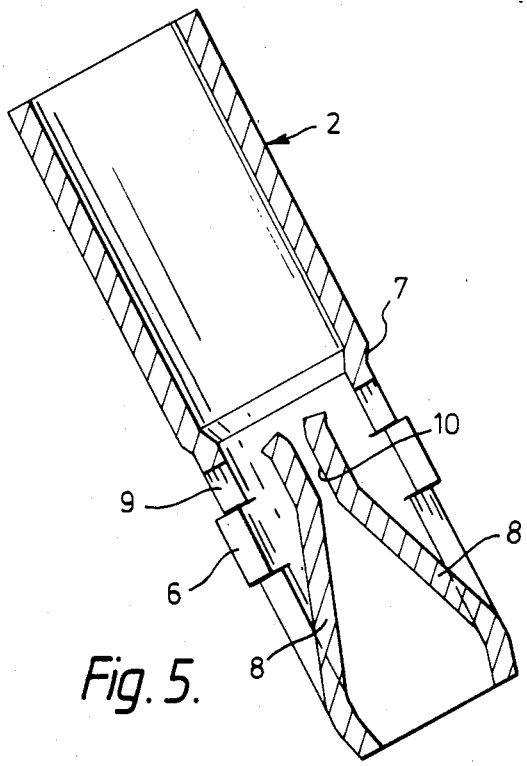
FIG. 5 is a cross-sectional view of the composite connector taken on the line V—V in FIG. 4.

Referring to FIGS. 1 to 5, the composite connector is formed by folding a sheet copper blank into generally tubular form and comprises, at one end of the connector, a socket 1 for insertion into a hole in a circuit board of the kind described and, at the other end of the connector, a tubular end portion 2 including two bifurcated contacts 3 at diametrically opposed positions around the connector. Parts 4 of the longitudinally extending free edges of the folded preform in the socket 1 are circumferentially spaced with respect to parts 5 of the longitudinally extending free edges of the folded preform in the tubular end portion 2. The socket 1 has an outwardly projecting dimple 6 for effecting a snap fit in a hole in a circuit board and, between the socket and the tubular end portion 2, the connector has an outwardly extending shoulder 7 for limiting the extent to which the connector can be inserted into a hole in a circuit board.

For resiliently gripping a terminal pin of a circuit component, the socket 1 has integral with its wall a pair of diametrically opposed inwardly extending resilient tongues 8, each of which is folded radially inwardly from a window 9 in the wall about an axis extending substantially normal to the axis of the composite connector and each of which has a substantially flat contact surface 10 carrying a coating of gold. The wall of the socket 1 also has a radially inwardly extending substantially flat surface 11 and, diametrically opposite this flat surface, an inwardly extending protrusion 12, the common axis of the flat surface 11 and protrusion 12 lying in a plane substantially parallel to the flat contact surfaces 10 of the tongues 8 and the flat surface and protrusion serving as guides for a terminal pin of a circuit component. The flat contact surfaces 10 of the resilient tongues 8 lie in planes which are at an acute angle of 60° to the common axis of the bifurcated contacts 3.

The opposed faces of the limbs 15 of each bifurcated contact 3 define a slot 16 for reception of a length of insulated wire and, over a part of their lengths nearer the closed end of the slot and over a major intermediate part of their widths, these faces are substantially flat and lie in planes which converge in a direction towards the axis of the composite connector. The corners of the limbs 15 of each bifurcated contact 3 are radiused at 17. At the open end of each bifurcated contact 3, parts of the limbs 15 are removed to provide a throat 18 to facilitate introduction of a length of insulated wire into the slot 16. In the wall of the tubular end portion 2 is a window 19 from which is radially inwardly folded a tongue 20 constituting a stop limiting the extent to which a terminal pin of a circuit component can be inserted into the socket 1.

Figure 6:
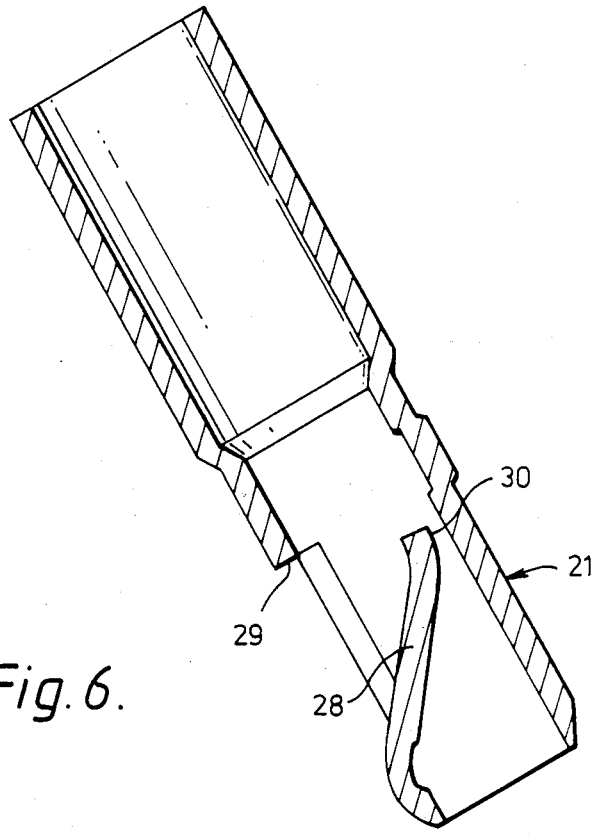
FIG. 6 is a cross-sectional view, similar to that of FIG. 5, of a modified form of the preferred composite connector.

In the modified form of the preferred composite connector shown in FIG. 6, the socket 21 has, integral with the wall of the socket, a single resilient tongue 28 which is folded radially inwardly from a window 29 in the wall about an axis extending substantially normal to the axis of the composite connector to such an extent that a terminal pin of a circuit component can be resilient gripped between the substantially flat contact surface 30 of the tongue and a diametrically opposed part of the wall of the socket.

Figure 7:
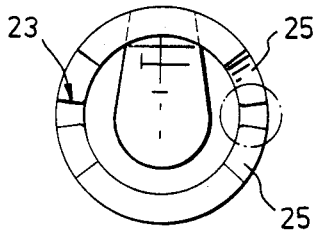
FIG. 7 is an end view of a modified form of the preferred composite connector drawn on a greatly enlarged scale.
Figure 8:
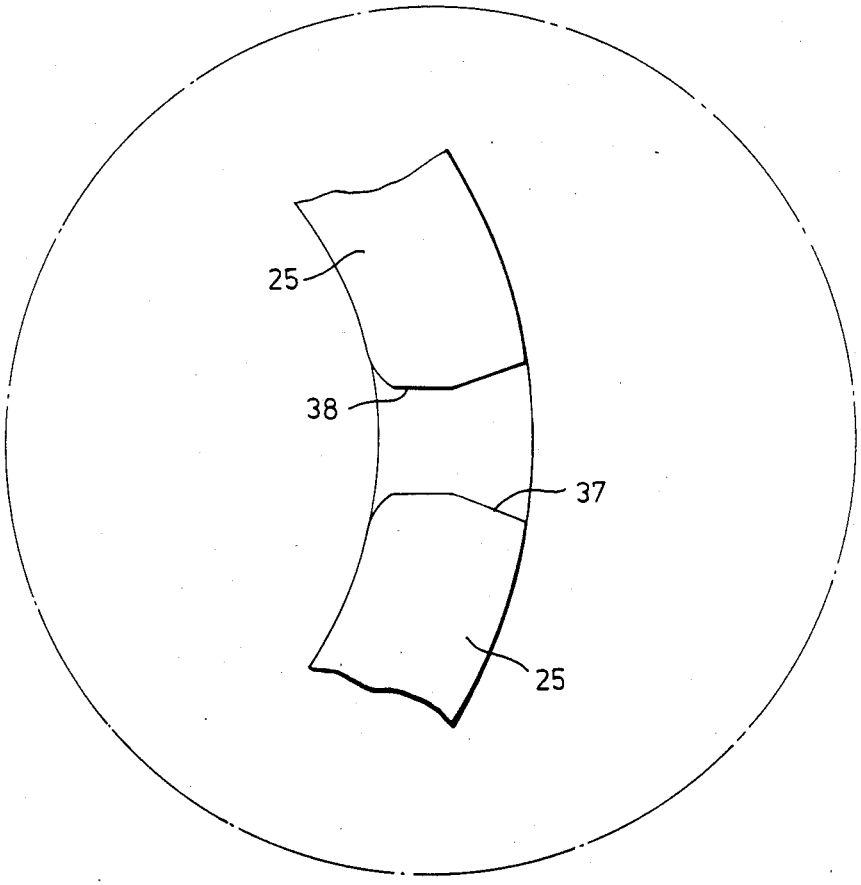
FIG. 8 is a fragmental detail, on an even greater scale, of the end view of the modified form of composite connector shown in FIG. 7.

In the modified form of the preferred composite connector shown in FIGS. 7 and 8, opposed faces of the limbs 25 of each bifurcated contact 23 are of such a form that, over a radially outer part 37 of their widths they are substantially flat and lie in planes which converge in a direction towards the axis of the composite connector and, over a radially inner part 38 of their widths, they are substantially flat and lie substantially parallel to the plane common to the axes of the bifurcated contacts and of the composite connector. In all other respects, the modified form of the preferred composite connector is substantially identical to the preferred composite connector shown in FIGS. 1 to 5.

In both cases, when a length of insulated wire is introduced between the limbs 15, 25 of the bifurcated contacts the limbs will displace the insulating covering of the wire to effect an electrical connection with the wire at two positions spaced along its length.

What we claim as our invention is:

1. For use with a circuit board of the kind comprising a board of electrically insulating material, a regular pattern of strips of electrically conductive metal or metal alloy bonded on one surface of the board and, extending through the board and the overlying electrically conductive metal strips, a multiplicity of holes distributed at spaced positions along the strips, a composite connector formed from a preform of electrically conductive sheet metal or metal alloy which is folded to form a tube having a seam defined by longitudinally extending free edges of the preform and extending from end to end of the composite connector and which is shaped to form, at one end of the composite connector, a socket of substantially circular cross-section which will make a fit in a hole in the circuit board and in which a terminal pin of a circuit component can be resiliently gripped and, at the other end of the composite connector, a tubular end portion of substantially circular cross-section having longitudinally extending slots which are at substantially diametrically opposed positions and whose axes lie in a plane transverse to the plane common to the axes of the composite connector and of said seam, each of which slots opens into that end of the composite connector and is bounded by marginal portions of said tubular end portion, which marginal portions and the slot bounded thereby constitute the limbs and an insulated wire-receiving opening of a bifurcated contact, the arrangement being such that, when a length of insulated wire is introduced into the opening between the limbs of each bifurcated contact, the limbs will displace the insulating covering of the wire to effect an electrical connection with the wire at at least tow positions spaced along its length, wherein parts of said longitudinally extending free edges defining the seam in the socket are circumferentially spaced with respect to parts of said longitudinally extending free edges defining the seam in the tubular end portion, whereby the thickness of the preform is such that the wall thickness of the socket and the wall thickness of the tubular end portion are substantially equal, and wherein the socket has, integral with that part of the preform forming the socket, resilient contact means for effecting electrical contact with a terminal pin of a circuit component, said integral resilient contact means being circumferentially spaced with respect to said slots.

2. A composite connector as claimed in claim 1, wherein the longitudinally extending free edges of the folded preform in the socket and in the tubular end portion abut.

3. A composite connector as claimed in claim 1, wherein the integral resilient contact means of the socket comprises a single resilient tongue which is folded radially inwardly from a window in the wall of the socket to such an extent that a terminal pin of a circuit component can be resiliently gripped between the tongue and a part of the wall of the socket substantially diametrically opposite the tongue.

4. A composite connector as claimed in claim 1, wherein the integral resilient contact means comprises a pair of diametrically opposed resilient tongues which are folded radially inwardly from windows in the wall of the socket and between which a terminal pin of a circuit component can be resiliently gripped.

5. A composite connector as claimed in claim 3 or 4, wherein the integral resilient tongue of the socket has a substantially flat contact surface.

6. A composite connector as claimed in claim 3 or 4, wherein the integral resilient tongue of the socket has a substantially flat contact surface which lies in a plane at an acute angle to the common axis of the bifurcated contacts lying in the range 60° to 65°.

7. A composite connector as claimed in claim 3 or 4, wherein the contact surface of the integral resilient tongue carries a coating of metal or metal alloy of high electrical conductivity.

8. A composite connector as claimed in claim 3 or 4, wherein the socket also has diametrically opposed radially inwardly extending protrusions whose common radially extending axis lies substantially parallel to the plane containing the flat contact surface of the integral resilient tongue, these protrusions serving as guides for a terminal pin of a circuit component.

9. A composite connector as claimed in claim 1, wherein the preform is of a copper-rich alloy having an overall protective coating of a tin-nickel alloy.

10. A composite connector as claimed in claim 1, wherein the opposed faces of the limbs of each bifurcated contact over at least a part of their lengths nearer the closed end of the slot bounded by the limbs and over at least a part of their widths are substantially flat and lie substantially parallel to the plane common to the axes of the bifurcated contacts and of the composite connector.

11. A composite connector as claimed in claim 1, wherein the opposed faces ot the limbs of each bifurcated contact over at least a part of their lengths nearer the closed end of the slot bounded by the limbs and over at least a part of their widths are substantially flat and lie in planes which converge in a direction towards the axis of the composite connector.

12. A composite connector as claimed in claim 1, wherein the opposed faces of the limbs of each bifurcated contact over at least a part of their lengths nearer the closed end of the slot bounded by the limbs are of such a form that, over a radially outer part of their widths, they are substantially flat and lie in planes which converge in a direction towards the axis of the composite connector and, over a radially inner part of their widths, they are substantially flat and lie substantially parallel to the plane common to the axes of the bifurcated contacts and of the composite connector.

* * * * *

UNITED STATES PATENT AND TRADEMARK OFFICE

CERTIFICATE OF CORRECTION

PATENT NO. : 4,598,963

DATED : July 8, 1986

INVENTOR(S) : CYRIL J. WHITE, CHRISTOPHER JOYCE

It is certified that error appears in the above-identified patent and that said Letters Patent is hereby corrected as shown below:

Column 5, claim 1, line 7, change "tow" to --two--.

Column 5, claim 1, line 12, change "whereby" to --wherein--.

Signed and Sealed this

Twenty-eighth Day of October, 1986

[SEAL]

*Attest:*

DONALD J. QUIGG

*Attesting Officer*

*Commissioner of Patents and Trademarks*